US005203636A

United States Patent [19]

Nishikawa

[11] Patent Number: 5,203,636

[45] Date of Patent: Apr. 20, 1993

[54] PRINTING APPARATUS CAPABLE OF DISTINGUISHING FUNCTIONING ABNORMALITIES

[75] Inventor: Hiroshi Nishikawa, Tokyo, Japan

[73] Assignee: Canon Kabushiki Kaisha, Tokyo, Japan

[21] Appl. No.: 841,199

[22] Filed: Feb. 27, 1992

Related U.S. Application Data

[63] Continuation of Ser. No. 622,277, Dec. 6, 1990, abandoned, which is a continuation of Ser. No. 436,131, Nov. 14, 1989, abandoned, which is a continuation of Ser. No. 165,397, Feb. 29, 1988, abandoned, which is a continuation of Ser. No. 85,246, Aug. 11, 1987, abandoned, which is a continuation of Ser. No. 791,398, Oct. 25, 1985, abandoned.

[30] Foreign Application Priority Data

Dec. 11, 1984 [JP] Japan ..... 59-236822
Dec. 11, 1984 [JP] Japan ..... 59-236823

[51] Int. Cl.[5] ..... B41J 29/38

[52] U.S. Cl. ..... 400/54; 400/74

[58] Field of Search ..... 400/54, 74, 144.2, 144.3, 400/146, 154.2, 162.3, 163, 902, 903; 101/93.13, 93.14, 93.17; 318/563, 565, 602, 638, 639, 652, 695, 696, 640; 371/25, 47

[56] References Cited

U.S. PATENT DOCUMENTS

| | | | |
|---|---|---|---|
| 173,718 | 2/1876 | Edison | 400/124 |
| 4,389,129 | 6/1983 | Sugiura | 400/54 |
| 4,582,438 | 4/1986 | Okabayashi | 400/54 |

FOREIGN PATENT DOCUMENTS

| | | | |
|---|---|---|---|
| 3032857 | 3/1981 | Fed. Rep. of Germany | 400/903 |
| 41203 | 3/1980 | Japan | 400/54 |
| 101488 | 8/1980 | Japan | 400/54 |
| 103870 | 6/1982 | Japan | 400/144.2 |
| 203060 | 11/1983 | Japan | 400/144.2 |
| 1886679 | 11/1983 | Japan | 400/154.4 |

*Primary Examiner*—David A. Wiecking
*Attorney, Agent, or Firm*—Fitzpatrick, Cella, Harper & Scinto

[57] ABSTRACT

There is described a printer with a mechanism for detecting abnormality in the printing mechanism such as a type font wheel. The detection at the start of power supply is effected with a criterion different from that in the course of printing operation, in order to simplify the operation for the initial errors encountered at the start of power supply.

30 Claims, 5 Drawing Sheets

ERROR LOCK IS PERFORMED.

PRINTING APPARATUS CAPABLE OF DISTINGUISHING FUNCTIONING ABNORMALITIES

This application is a continuation of application Ser. No. 07/622,277 filed Dec. 6, 1990, which is a continuation of application Ser. No. 07/436,131 filed Nov. 14, 1989, which is a continuation of application Ser. No. 07/165,397 filed Feb. 29, 1988, which is a continuation of application Ser. No. 07/085,246 filed Aug. 11, 1987, which is a continuation application of Ser. No. 07/791,398 filed Oct. 25, 1985, all now abandoned.

BACKGROUND OF THE INVENTION

1. Field of the Invention

The present invention relates to a printing apparatus provided with detection means for detecting the amount of mechanical movement, and capable of effecting the printing operation according to a signal from the detection means.

2. Description of the Prior Art

In general, a printer performs printing operation by the movement of certain mechanical elements, such as a carriage or a type font wheel. There is already known a printer capable of detecting the movement of such elements and prohibiting the printing operation in case of an abnormality in the movement.

FIG. 1 illustrates an example of a printer, for electronic apparatuses, in which the printing operation is effected by a type font belt, and in which each type on the belt is detected by mechanical detection means composed of encoding plates 15, 16 and metal contactors 12*a*, 13*a*. Such printer may generate an error in the type detecting operation, for example due to an incomplete contact in the detection means, thus providing an erroneous print.

In order to avoid such error, there has been employed so-called error lock structure, in which the type detecting operation is conducted by circulating the type font belt by one cycle at a determined timing, for example at the end of each print line, and the data processing, data output for recording and data input from keyboard are prohibited in case an error is identified in the detection.

Such error lock function is provided for informing the operator of a disabled state for proper printing operation, and is indispensable for an electronic apparatus equipped with a printer in which the types of the type font wheel are detected by mechanical detection means as explained above.

It is already confirmed that the errors in the function of such type detection means are most frequent at the start of power supply after the printer has been left unused for a prolonged period, and become quite rare thereafter.

Therefore, in the conventional structure in which the error lock function is activated even for an error detected at the start of power supply, the error lock function is activated often at the start of power supply so that the operator is required to execute a procedure for cancelling such error lock state, such as the actuation of a clear key "C".

On the other hand, the prevention of a detection error at the start of supplying power requires a measure involving an additional cost, such as the application of special oil to the detection mechanism, in order to ensure complete function of the type detection means even at the start of supplying power.

SUMMARY OF THE INVENTION

An object of the present invention is to provide a printer allowing achievement of improved operability and a reduced manufacturing cost.

Another object of the present invention is to provide a printer capable of flexible detection for movable elements according to varied situations.

Still other objects of the present invention, and the advantages thereof, will become fully apparent from the following description.

DETAILED DESCRIPTION OF THE PREFERRED EMBODIMENTS

Now the present invention will be clarified in detail by embodiments thereof shown in the attached drawings.

Figure 2:
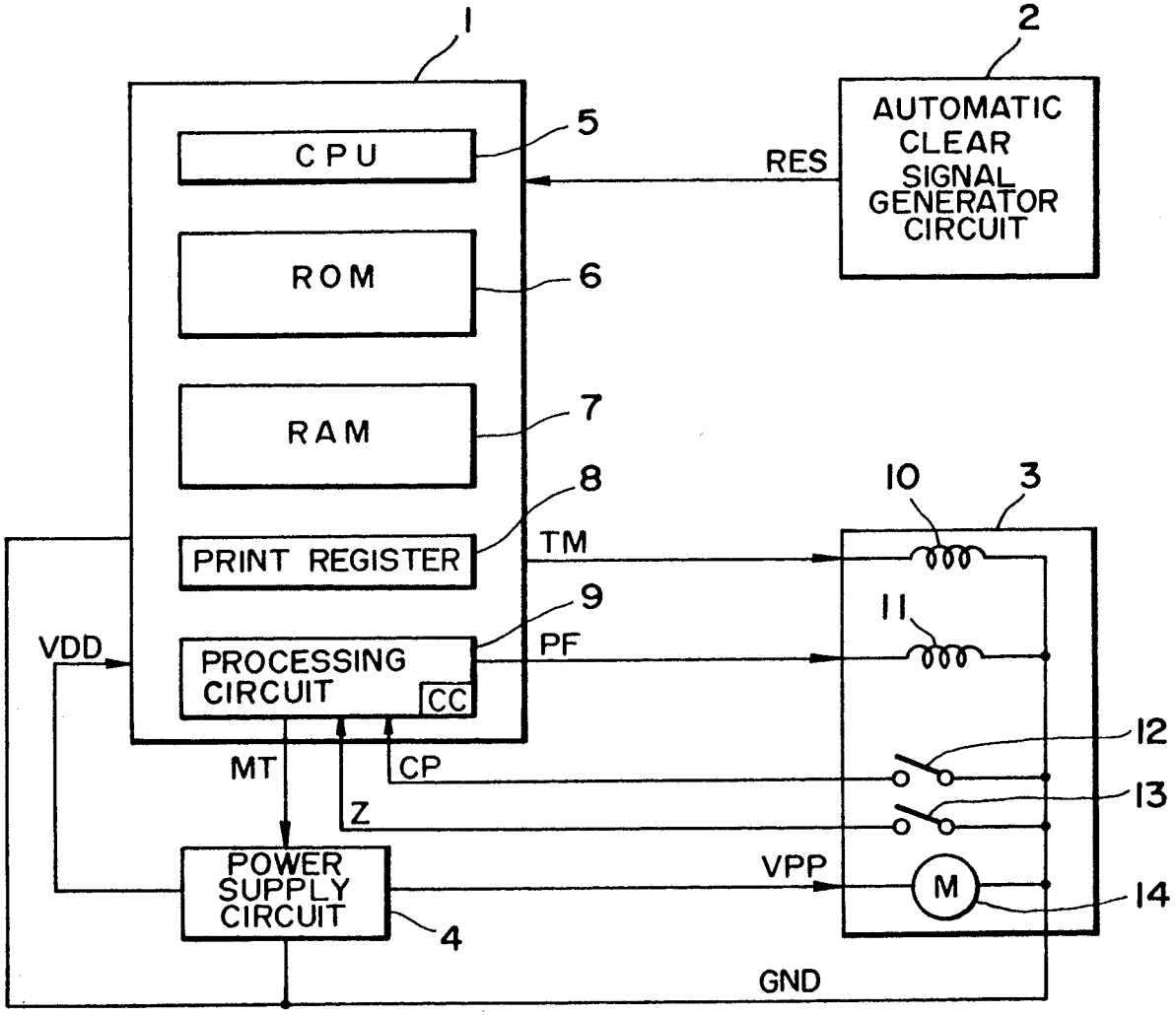
FIG. 2 is a block diagram of a principal part of an electronic apparatus equipped with a printer embodying the present invention.

FIG. 2 is a block diagram showing structure around a control unit and a printer, in an electronic apparatus equipped with a printer of the present invention and constructed as a table-top electronic calculator.

In FIG. 2 there is provided a control unit 1 for controlling the entire electronic apparatus, to which are connected a printer 3 constituting an output device, a power supply circuit 4 for supplying the control unit 1 and printer 3 with driving voltages $V_{DD}$ and $V_{PP}$, and an automatic clear signal generating circuit 2 for supplying the control unit 1, at the start of power supply, with an automatic clear signal RES to be explained later.

The control unit 1 is composed of a known central processing unit (CPU) 5, which, in response to various instructions entered through input means such as a keyboard, reads microinstructions in succession from a read-only memory (ROM) 6 according to the count of an unrepresented program counter and executes such microinstructions. The program execution is conducted utilizing a random access memory (RAM) 7 for temporarily storing numerical data and intermediate results of execution, and the results are stored in a print register 8. The control unit 1 is further provided with a processing circuit 9 composed of gates and flip-flops, in order to process character pulse CP, zero pulse Z, paper feed signal PF and motor signal MT to be explained later, under the control by the CPU 5.

Figure 1:
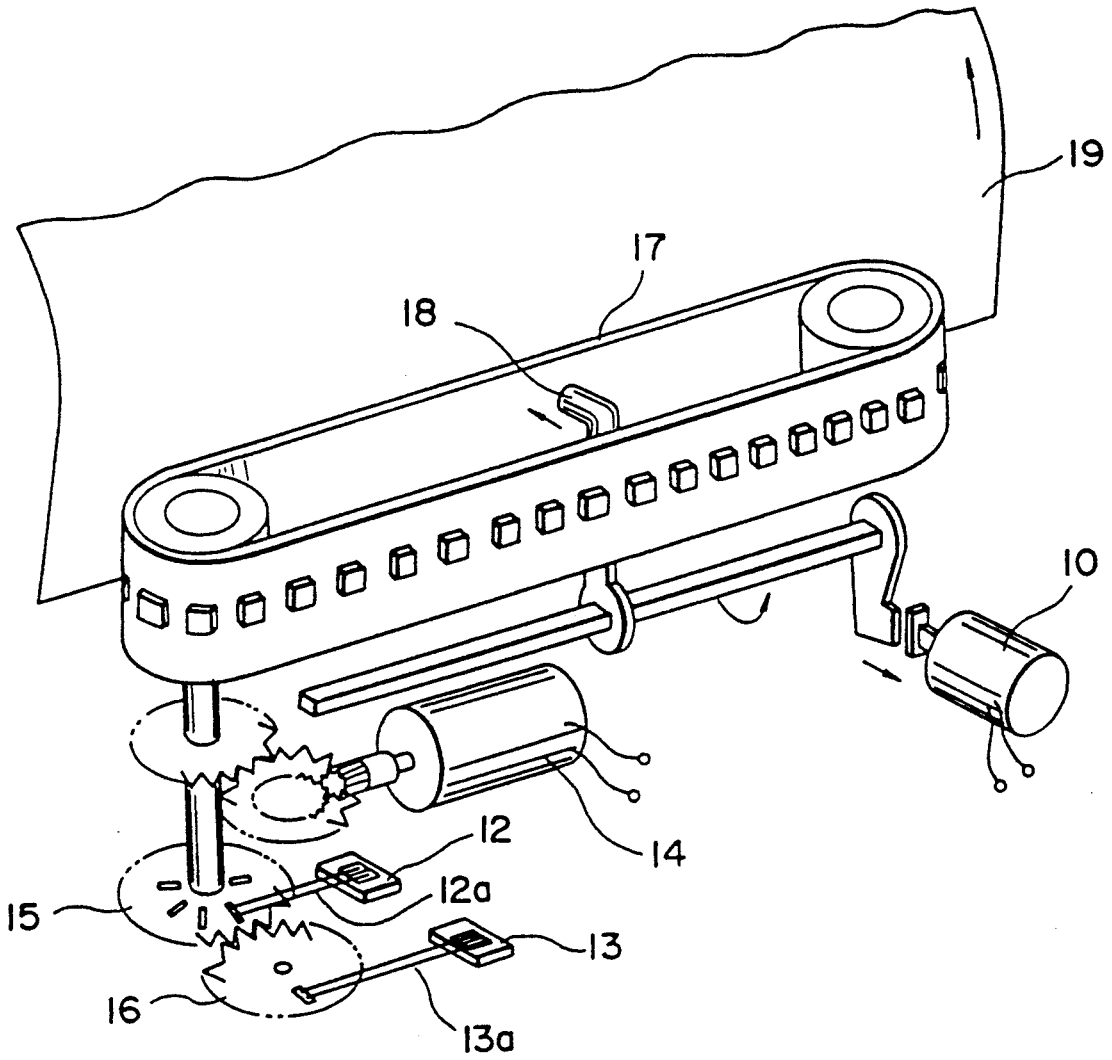
FIG. 1 PRIOR ART
FIG. 1 is a perspective view of a printer equipped with a type font belt.

The printer 3, designed to perform printing operation by a type font belt 17 shown in FIG. 1, is provided with the type font belt 17, a motor 14 for rotating the type font belt 17, encoding disks 15, 16 rotated in synchronism with the type font belt, type detection means 12 for detecting the position of types from the encoding disks, home position detection means 13 for detecting a home position, and a printing hammer 18 to be driven by a driving solenoid 10.

At the printing operation, a motor driving voltage $V_{PP}$ is supplied from the power supply circuit 4 to the motor 14 in response to a motor signal MT supplied from the processing circuit 9 to the power supply circuit 4, thus activating the motor 14 and rotating the type font belt 17. The types of the type font belt 17 brought in succession to the printing position are detected by the type detection means 12 and the home position detection means 13. Also in response to the print data stored in the print register 8 shown in FIG. 2, a trigger magnet signal TM is supplied to the driving solenoid 10, thereby activating the printing hammer 18 shown in FIG. 1 to hit a desired type on the type font belt 17, thus achieving a printing operation.

Upon completion of printing operations of a line, the processing circuit 9 shown in FIG. 2 releases a paper feed signal PF, which is supplied to a paper feed solenoid 11 for advancing a recording paper 19 shown in FIG. 1 by a determined pitch.

When not in the printing operation, the motor driving voltage $V_{PP}$ is reduced to the ground level in response to the motor signal MT, thus stopping the motor 14 and the type font belt 17 shown in FIG. 1.

At a determined timing, for example at the end of printing of a line, the type font belt 17 is rotated without printing operation to examine the state of the type detecting operation, and, in the presence of an error in the detection, the aforementioned error lock function is activated by the CPU 5 shown in FIG. 2.

On the other hand, the automatic clear signal generator 2 supplies an automatic clear signal RES at the start of power supply to the CPU 5, which thus executes an automatic clear process of the present invention.

Now reference is made to FIGS. 3(A) to 3(D) for explaining the type detecting operation and the method of identifying the status of the operation by means of the type detection means 12 and the home position detection means 13.

Figures 3A, 3B, 3C, 3D:
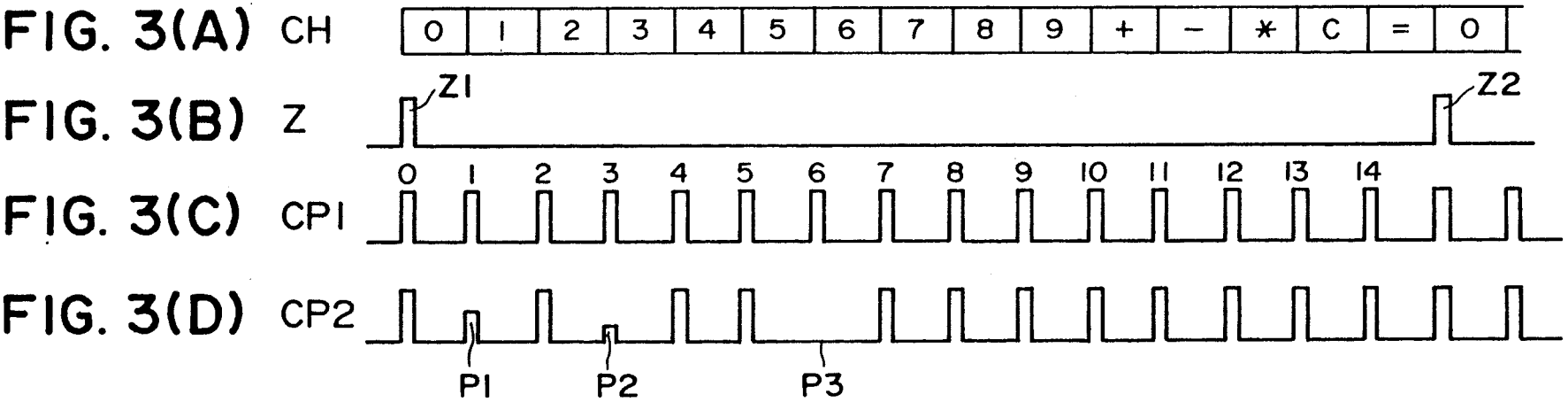
FIGS. 3(A) to 3(D) are timing charts for explaining the type detecting operation with the circuit shown in FIG. 2.

As shown in FIG. 3(A), it is assumed that the type font belt is provided with 15 types "0"-"=" which are brought to the printing position in the illustrated order by the rotation of the type font belt 17. The home position detection means 13 generates a zero pulse Z shown in FIG. 3(B), when the type font belt 17 reaches a home position, in which, in the present case, the type "0" is placed at the printing position. Consequently a zero pulse Z is generated for a determined amount of rotation of the type font belt.

On the other hand, the type detection means 12 shown in FIGS. 1 and 2 generates a character pulse CP each time a type is brought to the printing position. In the normal function of the type detection means 12, the character pulses CP are generated as shown by CP1 in FIG. 3(C). Consequently 15 character pulses CP 1 are generated for each complete rotation of the type font belt.

It is therefore rendered possible to detect a desired type, by counting the character pulses CP1, starting from the zero pulse z. The counting is effected by a counter CC provided in the processing circuit 9 shown in FIG. 2.

On the other hand, in case the function of the type detection means 12 is erroneous, for example at the start of supplying power, the character pulses CP become as shown by CP2 in FIG. 3(D), wherein certain pulses do not assume the expected high level "1" but are lowered to a half level, as represented by P1 and P2, or to a low level, as represented by P3. In such case, the number of character pulses CP2, counted by the aforementioned counter from a first zero pulse Z1 to a second zero pulse Z2, corresponding to the rotation of a determined amount of the type font belt, becomes less than 15. On the other hand, in case of an erroneous function of the home position detection means 13 shown in FIGS. 1 and 2, the number of character pulses CP becomes larger than 15.

Consequently, the functional status of the type detection means 12 and the home position detection means 13 can be discriminated according to whether the count of the character pulses CP from a zero pulse to a succeeding zero pulse is equal to 15.

In the following there will be explained the details of the aforementioned automatic clear process in the present embodiment.

Figure 4:
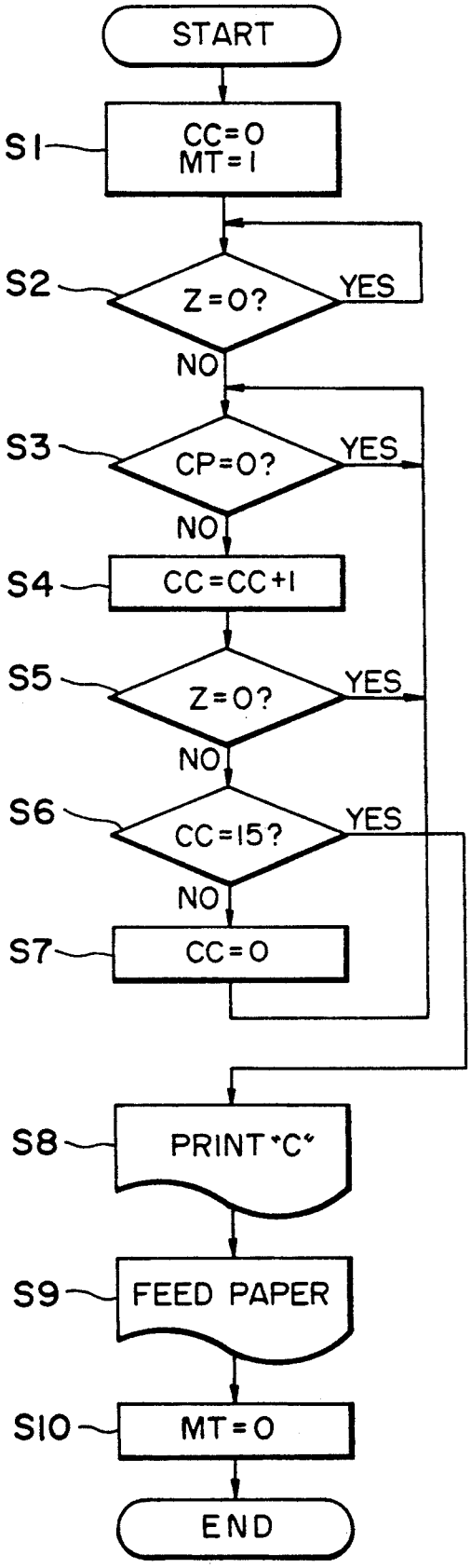
FIG. 4 is a flow chart indicating the control operation in the automatic clear process by a central processing unit shown in FIG. 2.

FIG. 4 is a flow chart showing the control procedure for the automatic clear process by the CPU 5 shown in FIG. 2. As explained before, this control procedure is initiated by the CPU 5, in response to an automatic clear signal RES generated by the automatic clear signal generator 2 at the start of power supply to the printer.

Referring to FIG. 4, a first step S1 clears the aforementioned counter CC provided in the processing circuit 9 for counting the character pulses CP, and shifts the motor signal MT to "1", thus activating the motor 14 to rotate the type font belt 17 shown in FIG. 1.

A succeeding step S2 identifies whether the zero pulse Z has been detected, and, if not, awaits the detection of zero pulse Z by repeating the identification.

Upon detection of a zero pulse, the program proceeds to a step S3 which identifies whether a character pulse CP has been identified, and, if not, awaits the detection of a character pulse CP by repeating the identification.

Upon detection of a character pulse CP, the program proceeds to a step S4, thus adding "1" to the count of the counter CC.

A succeeding step S5 identifies whether the zero pulse Z is at a logic level "0", and, if so, the program returns to the step S3 to repeat the operations of the aforementioned steps S3 to S5.

In this manner the character pulses CP are detected until the type font belt 17 shown in FIG. 1 is rotated by a determined amount, and the number of the character pulses CP is counted by adding "1" to the count of the counter CC at each detection.

When the step S5 detects a zero pulse after the rotation of the type font belt by a determined amount, the program proceeds to a step S6 for identifying whether the count is equal to 15, a count indicating that the type detection means 12 and the home position detection means 13 shown in FIG. 2 are functioning in proper manner.

In case the count is not equal to 15, i.e. in case of an erroneous detection, the program proceeds to a step S7 to clear the counter CC, and then returns to the step S3 to repeat the procedures of the steps S3 to S7.

In this manner the status of the detecting operation is examined by rotating the type font belt and activating the type detection means 12 and home position detection means 13 until the proper function thereof is confirmed in the step S6. Stated differently the type detection means 12 and the home position detection means 13 are maintained in idling operation until the function thereof becomes normal. It is important to note that the error lock function is not activated during the above-mentioned operation.

When the erroneous functional state of the type detection means 12 or the home position detection means 13 is resolved in this manner to derive an affirmative identification in the step S6, the program proceeds to a step S8 to print a character "c" representing a cleared state, indicating the absence of error lock state. A succeeding step S9 advances the recording paper by a pitch, and a step S10 shifts the motor signal MT to "0", thus stopping the motor 14 and terminating the control procedure.

As explained above, in the foregoing embodiment, the type detection means 12 and the home position detection means 13 are rendered active at the start of power supply, until the absence of erroneous type detection is identified, and the error lock function is prohibited during the above-explained operation. Consequently the error lock state at the start of power supply is avoided, and the frequency of error lock states in the entire use of the printer can be significantly reduced.

In the above-explained control procedure, the type detecting operation is repeated until the absence of erroneous function in the type detection means 12 and the home position detection means 13 is confirmed. However, it is also possible to activate the error lock function in case the erroneous detecting function is not resolved even after the repetition reaches a predetermined amount, defined for example by the amount of rotation or the time. The frequency of error lock states can also be significantly reduced in such structure.

Also it will be obvious that the present invention is not limited to the printer with a type font belt as shown in FIG. 1 but is applicable to any electronic apparatus equipped with a printer with other type fonts for printing.

In the following there will be explained another embodiment of the automatic clear procedure.

Figure 5:
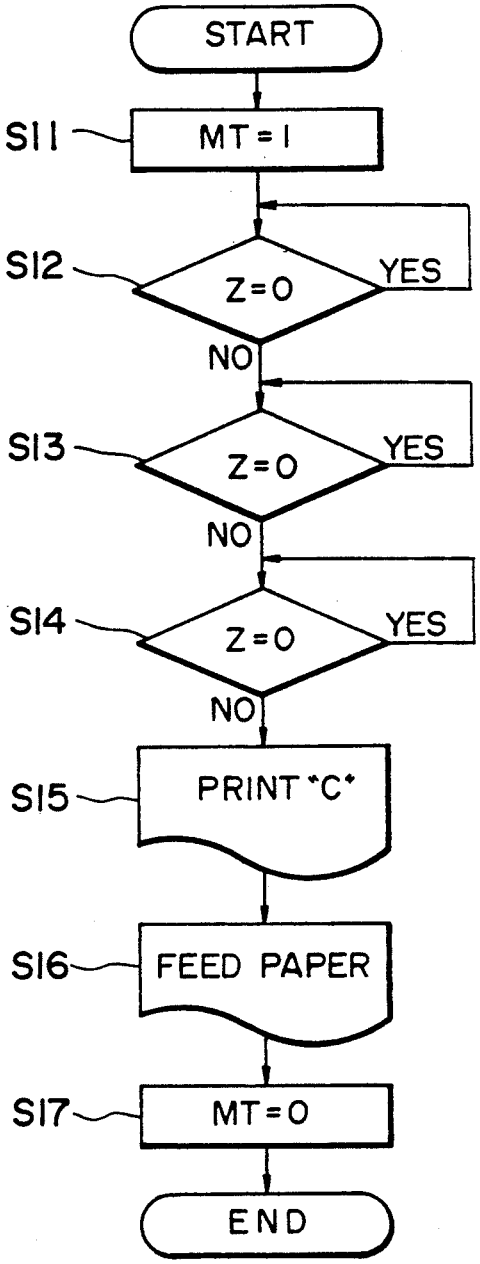
FIG. 5 is a flow chart showing another embodiments.

FIG. 5 is a flow chart showing a control procedure for the automatic clear process by the CPU 5 shown in FIG. 2. As explained before, this control procedure is initiated by the CPU 5, in response to an automatic clear signal RES generated by the automatic clear signal generator 2 at the start of power supply to the printer.

Referring to FIG. 5, a first step S11 shifts the motor signal MT to a level "1", thus activating the motor 14 shown in FIGS. 1 and 2 to rotate the type font belt 17 shown in FIG. 1.

A succeeding step S12 identifies whether a zero pulse Z has been detected, and, if not, awaits the detection of zero pulse Z by repeating the identification.

Upon detection of a zero pulse, the program proceeds to a step S13 to effect a same identification as in the step S12 to await the detection of a zero pulse, and, upon detection thereof, a step S14 effects a same identification to await the detection of another zero pulse.

Upon detection of the zero pulse Z, the program proceeds to a step S15. If the type font belt is in the home position, where the type "0" is placed at the printing position, at the start of power supply, the type font belt 17 shown in FIG. 1 will be rotated three cycles in the above-mentioned steps S12 to S14.

It is however, limited to the case where the home position detection means 13 shown in FIGS. 1 and 2 is functioning normally, and the type font belt is rotated more than three cycles in case of erroneous function of the means.

It is important to note that, though the type detection means 12 and the home position detection means 13 are both maintained active during the rotation of the type font belt, the error lock function is not activated during the rotation even if an erroneous function is found in the type detection means 12 or in the home position detection means 13.

A succeeding step S15 prints a character "C" representing a cleared state, or the absence of error lock state. A succeeding step S16 advances the recording paper by a pitch, and a step S17 shifts the motor signal MT to a level "0", thus stopping the motor 14 and terminating the control procedure.

As explained above, the type font belt in the present embodiment is rotated at least three cycles at the start of power supply, whereby the type detection means 12 and the home position detection means 13 are activated at least for a determined number of times. During this operation, the error lock function is not activated even if the function of the means 12 or 13 is erroneous. The erroneous function of the means 12 or 13 is resolved in most cases during the activations thereof exceeding the determined number.

Consequently, the frequency of error lock states throughout the entire time of use can be significantly reduced.

Figure 6:
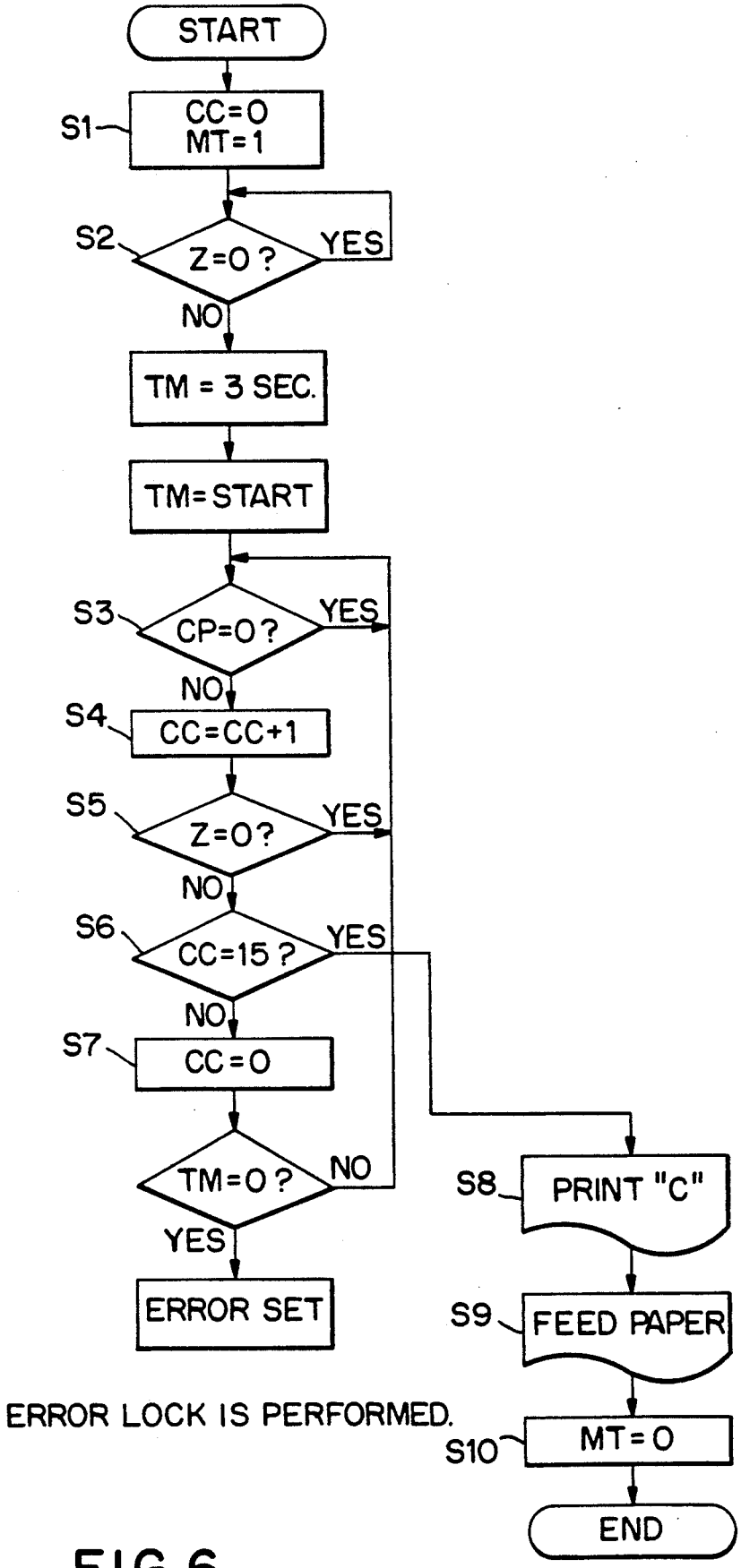
FIG. 6 is a flow chart showing yet another embodiment of the invention.

The minimum amount of rotations of the type font belt at the start of power supply is naturally not limited to three cycles as in the foregoing embodiment but can be defined by an arbitrary number of cycles or as shown in alternative embodiment FIG. 6, by an arbitrary length of time.

What is claimed is:

1. A printer for recording on a recording medium, comprising:

recording means for recording on a recording medium;

error detecting means for detecting an erroneous drive of said printer;

a voltage source;

storing means for storing a predetermined time period; and operating means for operating said error detecting means such that an error lock operation in accordance with error detection is prohibited for the predetermined time period when said error detecting means detects an error initially after turning on said voltage source, and for releasing the prohibition of the operation in accordance with the error detection when the operation of said error detecting means is normal in operation.

2. A printer according to claim 1, wherein said predetermined time period corresponds to a time from when said voltage source is turned on to when the error lock is to be activated.

3. A printer according to claim 1, wherein said error detecting means has means for detecting a character.

4. A printer according to claim 1, wherein said error detecting means has means for detecting a home position.

5. A printer according to claim 1, wherein said printer is an impact printer and a character provided on a character belt is impacted against the recording medium by a hammer so as to effect recording.

6. A printer for recording on a recording medium, comprising:

error detecting means for detecting abnormal driving of said printer;

a voltage source;

storing means for storing a predetermined time period; and operating means for operating said error detecting means such that an error lock operation based on error detection is prohibited during the predetermined time period after said voltage source is turned on.

7. A printer according to claim 6, wherein said predetermined time period varies in accordance with a stopping position of a character belt.

8. A printer according to claim 6, wherein said abnormal driving detection starts after a character belt passes a home position.

9. A printer according to claim 6, wherein said error detecting means detects said abnormal driving by determining whether a predetermined number of second pulses is generated, with said second pulses being generated for each character provided on a character belt between first pulses generated when said character belt passes a home position.

10. A printer according to claim 6, wherein said abnormal driving of said printer includes an abnormal operation of said error detecting means.

11. A printer according to claim 6, wherein said operating means inhibits an error lock which warns an operator that a normal recording is not available when said error detecting means detects the error till said error detecting means detects no errors when said voltage source is turned on.

12. A printer according to claim 6, wherein said operating means performs an error lock if a predetermined error is detected in a state that error lock which warns an operator that a normal recording is not available is inhibited even when said error detecting means detects the error.

13. A printer according to claim 6, wherein said predetermined time period corresponds to a time from when said voltage source is turned on to when the error lock is to be activated.

14. A printer according to claim 6, wherein said error detecting means has means for detecting a character.

15. A printer according to claim 6, wherein said error detecting means has means for detecting a home position.

16. A printer according to claim 6, wherein said printer is an impact printer and a character provided on a character belt is impacted against the recording medium by a hammer so as to effect recording.

17. A recording method for recording on a recording medium with a printer, said method comprising the steps of:

detecting abnormal driving of the printer with an error detecting device;

supplying a voltage source to the printer;

storing a predetermined time period; and operating the error detecting device such that an error lock operation based on error detection is prohibited during the predetermined time period after the voltage is turned on.

18. A method according to claim 17, further comprising the step of initiating the abnormal driving detection after a character belt passes a home position.

19. A method according to claim 17, wherein the detecting step detects abnormal driving by determining whether a predetermined number of second pulses is generated, with the second pulses being generated for each character provided on a character belt between first pulses generated when the character belt passes a home position.

20. A method according to claim 17, further comprising the step of inhibiting the error lock which warns an operator that a normal recording is not available when abnormal driving is detected until the error detecting device detects no errors when the voltage source is turned on.

21. A method according to claim 17, further comprising the step of performing an error lock if a predetermined error is detected in a state that error lock, which warns an operator that a normal recording is not available, is inhibited even when the error detecting device detects abnormal driving of the printer.

22. A method according to claim 17, wherein a predetermined time period corresponds to a time when the voltage source is turned on to when the error lock is to be activated.

23. A method according to claim 17, further comprising the step of detecting a character with the error detecting device.

24. A method according to claim 17, further comprising the step of detecting a home position with the error detecting device.

25. A method according to claim 17, wherein the printer is an impact printer and further comprising the step of impacting a character provided on a character belt of the printer against the recording medium so as to effect recording.

26. A method for recording on a recording medium with a printer, said method comprising the steps of:

recording on a recording medium;

detecting an erroneous drive of the printer with an error detecting device;

supplying a voltage source to the printer;

storing a predetermined time period; and operating the error detecting device such that an error lock operation in accordance with error detection is prohibited for the predetermined time period when the error detecting device detects an error initially after turning on the voltage source, and for releasing the prohibition of the operation in accordance with the error detection when the operation of the error detecting device is normal in operation.

27. A method according to claim 26, wherein the predetermined time period corresponds with time from when the voltage source is turned on to when the error lock is to be activated.

28. A method according to claim 26, further comprising the step of detecting a character with the error detecting device.

29. A method according to claim 26, further comprising the step of detecting a home position with the error detecting device.

30. A method according to claim 26, wherein the printer is an impact printer and further comprising the step of impacting a character provided on a character belt of the printer against the recording medium so as to effect recording.

* * * * *

UNITED STATES PATENT AND TRADEMARK OFFICE

CERTIFICATE OF CORRECTION

PATENT NO. : 5,203,636

DATED : April 20, 1993

INVENTOR(S) : Hiroshi Nishikawa

It is certified that error appears in the above-indentified patent and that said Letters Patent is hereby corrected as shown below:

On the title page, item [30]: Foreign Application Priority Data:

"Dec. 11, 1984 [JP] Japan ... 59-236822" should read --Nov. 12, 1984 [JP] Japan ... 59-236822--.
"Dec. 11, 1984 [JP] Japan ... 59-236823" should read --Nov. 12, 1984 [JP] Japan ... 59-236823--.

Title page, item

[56] REFERENCES CITED:

FOREIGN PATENT DOCUMENTS, "1886679 11/983 Japan" should read --188679 11/1983 Japan--.

Signed and Sealed this

Twenty-fourth Day of January, 1995

*Attest:*

Bruce Lehman

BRUCE LEHMAN

*Attesting Officer*

*Commissioner of Patents and Trademarks*